US006120383A

United States Patent [19]

Brown

[11] Patent Number: 6,120,383

[45] Date of Patent: Sep. 19, 2000

[54] APPARATUS FOR PLACING A GOLF BALL ON A TEE

[76] Inventor: Louis S. Brown, 401 Colbert Ave., Pensacola, Fla. 32507

[21] Appl. No.: 09/198,743

[22] Filed: Nov. 24, 1998

[51] Int. Cl.[7] ..... A63B 57/00

[52] U.S. Cl. ..... 473/135

[58] Field of Search ..... 473/132–137

[56] References Cited

U.S. PATENT DOCUMENTS

| | | | |
|---|---|---|---|
| 4,265,453 | 5/1981 | Loof | 473/137 |
| 4,662,641 | 5/1987 | Peyret, Jr. . | |
| 5,297,797 | 3/1994 | Lamontagne | 473/136 |
| 5,415,409 | 5/1995 | Hellman | 473/136 |
| 5,549,299 | 8/1996 | Brown | 473/133 |
| 5,645,491 | 7/1997 | Brown | 473/135 |

*Primary Examiner*—Steven Wong
*Attorney, Agent, or Firm*—Dennis G. LaPointe; Mason & Associates, PA

[57] ABSTRACT

An apparatus that positions a golf ball on a tee, retrieves and positions a new ball on the tee each time a golfer makes a tee shot. A bucket of balls is charged into the apparatus, and a ramp directs the balls, one at a time, to a tee loading station. Alternatively, balls can enter the tee loading station from an automatic ball dispensing machine by gravity or force-feed. As the tee rotates forward and down, the rotary tee action drives the tee into a ball in the tee loading station. The tee has a bore formed in it that communicates with a source of negative pressure so that a tee driven into contact with the ball is held to the tee by vacuum. The resulting increase in a vacuum line reconfigures a four way valve and activates a mechanism that rotates the tee and ball into a vertical position so that the golfer may strike the ball. The shot disconnects the ball from the tee, resulting in bleeding of the vacuum line, and reconfiguration of the four way valve. The valve activates a mechanism that rotates the tee so that it may retrieve another ball from the tee loading station. The apparatus includes means for adjusting the height to which a ball is teed. The apparatus top wall is a composite of artificial turf and elastomer which exhibits a flexible cushioning surface.

14 Claims, 14 Drawing Sheets

APPARATUS FOR PLACING A GOLF BALL ON A TEE

BACKGROUND OF THE INVENTION

1. Field of the Invention

The invention relates, generally, to devices having utility in practicing or playing the game of golf. More particularly, it relates to an apparatus that automatically places a golf ball on a tee.

2. Description of Related Art

Since those who want to play the game of golf well must invest many hours of practice thereinto, driving ranges have been established so that golfers desiring to practice their tee shot may stand in one location and hit numerous shots without having to retrieve the balls.

Typically, a golfer pays a fee to the owner of a driving range for a bucket containing a predetermined number of golf balls. The bucket is carried to a concrete pad, typically covered with an artificial turf, and the golf balls are removed from the bucket, one at a time, and placed on a tee means that is mounted on the pad. After each ball has been hit, the golfer retrieves another ball from the bucket, places it on the tee, and makes another practice tee shot.

The act of retrieving balls from the bucket requires the golfer to bend over or to kneel or to stoop down. Moreover, the ball must be placed on a tee while the golfer remains in the bent, or kneeling or stooped position. Then, the golfer must return to a standing position to make the next shot.

The repeated bending and standing may increase the golfer's fatigue as the driving practice continues. Moreover, the time required to position a new ball on the tee after each shot ensures that emptying a single bucket of balls can take a substantial amount of time.

What is needed then, is a reliable device that will automatically position a new ball on a tee as soon as the tee shot has been made, thereby eliminating the kneeling, stooping and bending associated with manual ball deployment while improving a golfer's rhythm and timing and shortening the time required to complete a driving range session.

Devices intended to fulfill this need are known in the art. Known related art includes a golf ball tee machine depicted in U.S. Pat. No. 4,662,641 to Peyret, Jr. Although the device is operable, it is expensive to manufacture, is not as light weight as the present invention, and has several shortcomings. In operation, the device fails to pick up an unreasonably high percentage of balls, a high consumption of air is required to generate a high vacuum, balls tend to easily fall off the tee before the tee reaches a vertical position, and a distracting high decibel level is produced by the required powerful vacuum motor, such noise disturbing the usual tranquillity generally associated with a driving range. Further where the present invention utilizes control means to maneuver a tee from the position of ball pick-up to the vertical position for teeing a ball, Peyret, Jr. is directed to a constantly running belt with tee members in order to have the user time his swing to hit the balls. Further, the continuous belt system in Peyret, Jr. requires that the housing platform be eight to nine inches in height thereby making the Peyret, Jr. device awkward and unwieldy to use and requiring a step to step up onto the platform to comply with safety requirements.

Devices which obviate the shortcomings in Peyret, Jr. include U.S. Pat. Nos. 5,549,299 and 5,645,491 to the inventor herein. The present invention provides for a substantially improved lightweight, portable and inexpensive apparatus for placing a golf ball on a tee over that of the prior art devices issued to the inventor herein. This new and improved apparatus when combined with a net is cost-effective such that an individual, as opposed to a driving range operator, can afford to turn the backyard, garage or office or any small area into a personal driving range. In addition, to teeing up standard golf balls, the present invention is capable of teeing foam and plastic practice golf balls.

SUMMARY OF THE INVENTION

The present invention includes an opening into which is poured a plurality of golf balls from a bucket. The balls are supported within the device on an internal ball ramp that is slightly tilted with respect to horizontal so that the balls are urged by the force of gravity toward a tee loading station. The ramp is configured so that only one ball at a time may enter into the tee loading station.

In another embodiment of the present invention, the internal ball ramp may be removed if an external ball source is used. The external ball source may connect to the apparatus by conduit. Gravity feed or force feed can be used to urge the balls in single file order from the external ball source such that only one ball at a time may enter the tee loading station.

The invention includes numerous embodiments, but all of said embodiments operate in accordance with the same principles. The primary object of the present invention is to provide a simple and efficient mechanism for picking up a ball at a loading station and rotating the ball to a substantially vertical or 90° position where it presents the ball for hitting by the golfer. When the ball is in such substantially vertical position or striking position, the tee position is typically oriented about +/−(10° to 20°) from 90° depending on the adjusted height of the tee.

In all embodiments, a vacuum is employed to operate the device. Control is provided by a four way vacuum operated air pressure valve that sequentially directs air pressure to various locations within the device.

The mechanism rotates and drives a flexible tee into a ball at a loading station, such that the cup portion of the tee engages the ball in a tee loading station and the ball is retained by the tee due to the vacuum generated through a bore within the tee. In the most recent improved machine, when the mechanism picks up the ball, the mechanism is essentially between about 45° to 60° from horizontal. The ball receives the tee as the tee is driven into the ball in the loading station. Although the mechanism in the present invention rotates about 45° to 60° from horizontal to pick up a ball, that is, the rotary actuator holding the tee rotates about 135° to 150°, those skilled in the art may vary the angle of pick-up by simply reorienting the cooperative arrangement of the ball loading station with the rotary actuator holding the flexible tee. As soon as the ball is loaded onto the tee, the mechanism or rotary actuator quickly rights the tee so that the ball carried thereby is presented to the golfer so that a practice tee shot can be made.

The novel structure senses the departure of a ball from the tee so that as soon as the golfer completes the shot, the tee rotates to the tee loading station and retrieves another ball. In this way, a golfer can hit an entire bucket of balls without bending over, kneeling or stooping after each shot and without being required to position a ball on a tee.

The tee loading mechanism in all embodiments includes a vacuum source in fluid communication with a bore formed in the tee. As the rotary actuator rotates to the tee loading station, it drives the flexible tee into the ball and the ball is sealed by suction to the tee by the vacuum.

When the tee is in its pickup position and the tee seals against the golf ball, the vacuum circuit is closed and the diaphragm pushes down on the four way valve. The four way valve reconfigures and directs the pressure to a rotary actuator that revolves to position the tee and golf ball into an upstanding configuration so that the golfer may make a tee shot.

When the ball is dislodged from the tee, the vacuum circuit is broken. The internal spring in the four way valve pushes up the diaphragm as now only atmospheric pressure is exerted on it and the four way valve reconfigures and directs pressure to the opposite end of the rotary actuator to revolve the tee to the tee loading station so that another ball can be retrieved.

Another embodiment includes means for positioning the tee, when in its substantially vertical position, in relatively infinite tee heights between low or flush with the grass and high to simulate typical required heights that a golfer might experience. As noted above, when the ball is in such substantially vertical position or striking position, the tee position is typically oriented about +/−(10° to 20°) from 90° depending on the adjusted height of the tee.

It is therefore apparent that the primary object of this invention is to provide a machine that includes a self-setting adjustable height golf tee that is free of the limitations of prior devices in this field.

Another important object is to accomplish the foregoing object with a reliable mechanism that provides many hours of maintenance-free service.

Still another object is to fulfill the primary object with a light-in-weight, low profile device that is quiet in operation, completely portable, which may be battery operated if desired, and which has an internal ball storage area or can be adapted for an external ball feed source as described above.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE INVENTION

Figure 1:
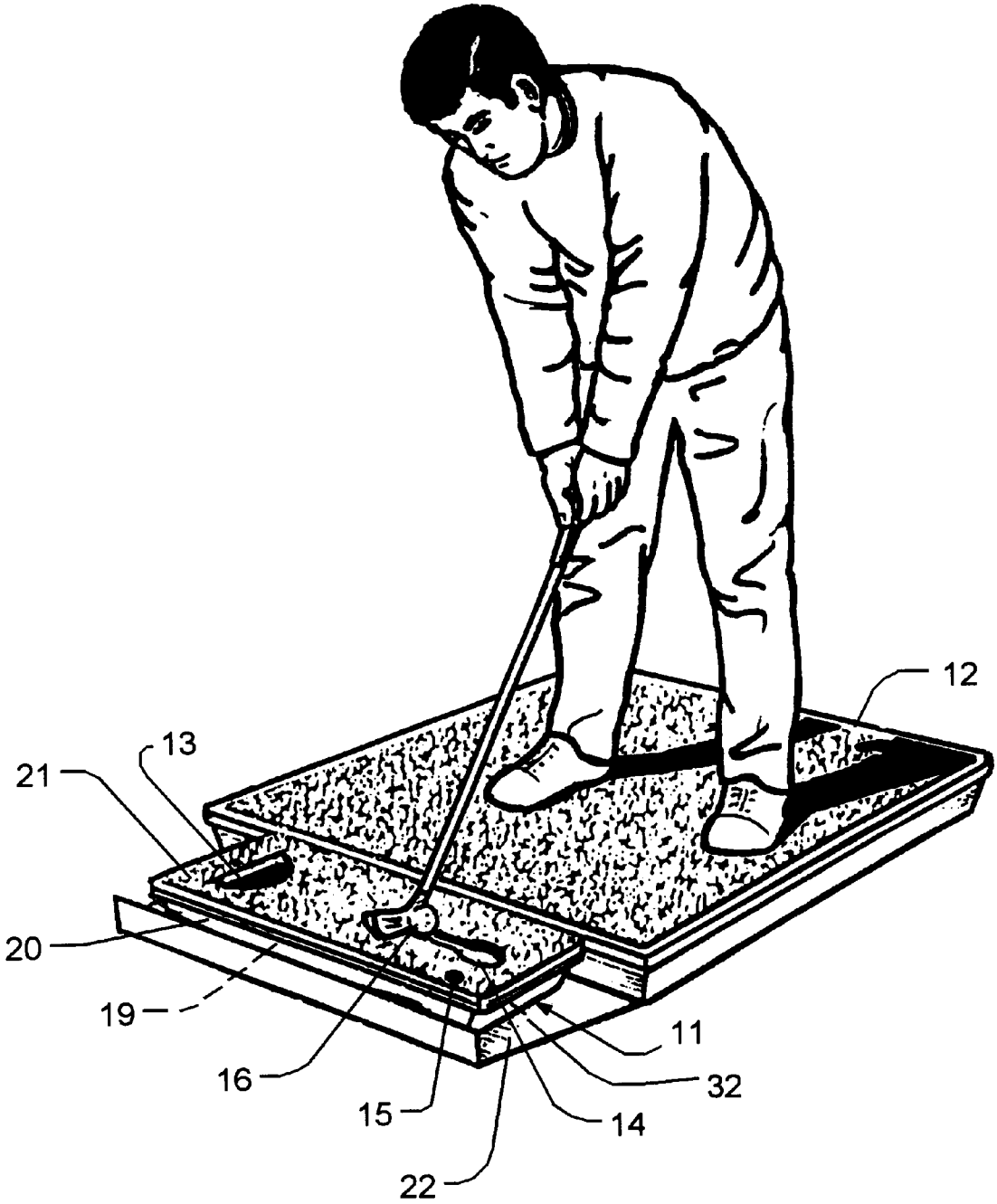
FIG. 1 is a perspective view of a golfer standing atop the novel device, preparing to address a golf ball positioned atop the novel tee.

FIG. 1 is an illustrative embodiment of the present invention. Referring to FIGS. 1–4 , a golfer stands atop platform 12 when using apparatus 11. The apparatus 11 is held in position by wing 22 attached to stance platform 12. The apparatus is turned on by actuating on/off valve 32. Golf balls are loaded in plurality into ball access opening 13. The reset button or stem 15 manually resets the diaphragm four way valve assembly which raises the tee assembly allowing a golf ball to enter the tee loading station. When the reset button is released, the golf tee rotates towards the golf ball 16. A vacuum seal is made, the 4-way valve and diaphragm is reconfigured to raise the golf ball 16 into strike position. The ball is maintained in this position until the golfer hits it. Upon removal of the ball from the tee, the tee returns to pick up another ball at the tee loading station.

Figure 2:
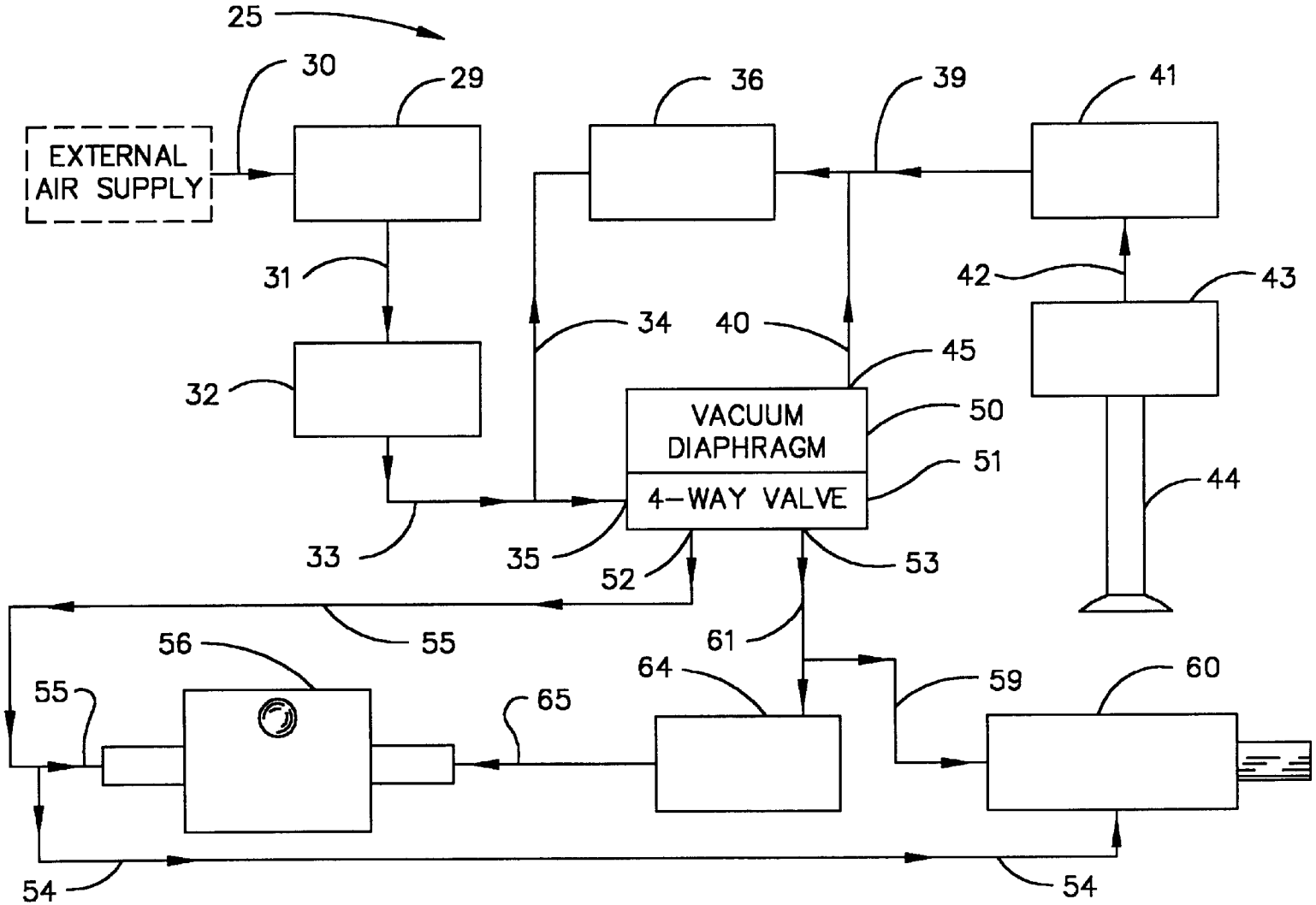
FIG. 2 is a schematic of the novel control means utilizing internal golf storage, manual feed and a golf jostling means.
Figure 6:
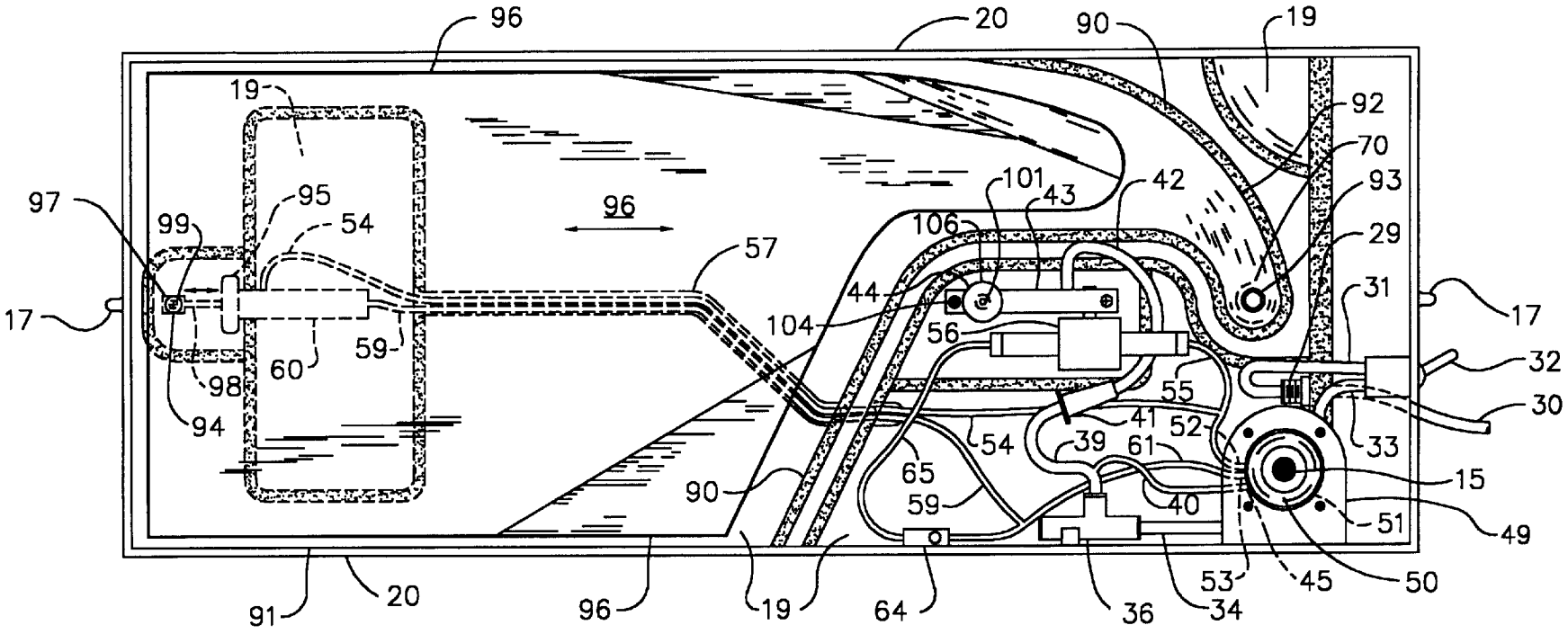
FIG. 6 is a perspective plan view of the apparatus with the top wall removed depicting the ball ramp and the tee in the ball strike position.

FIG. 2 is a diagrammatic representation of the control means for the mechanical assembly depicted in FIG. 6. The control means 25 includes an external air supply 30 to bulkhead fitting 29 then to on/off valve 32 through line 31. Filtered air pressure is produced and regulated by an external air compressor in this configuration to reduce the cost of manufacture. Air is delivered through line 33 to the four way valve pressure inlet 35 and then through line 34 to the vacuum generator 36.

Vacuum generator 36 supplies a vacuum through line 39 to inline vacuum filter 41 and through line 40 to vacuum inlet 45 of vacuum diaphragm So. The vacuum progresses through inline vacuum filter 41 to vacuum golf tee manifold 43 through line 42 and then to golf tee 44. Vacuum generator 36 simultaneously draws a vacuum through line 40 to vacuum inlet 45 on diaphragm 50 of four way valve 51 and on golf tee 44. More particularly, air from on/off valve 32 flows straight through from a constricted configuration causing a drop in pressure by increased velocity in vacuum generator 36, i.e., creating a venturi effect which is harnessed by vacuum line 39.

Four way valve pressure outlet 52 of four way valve 51 is in communication with first actuator 56, said actuator being a rotary actuator, through line 55. Four way valve pressure outlet 52 is simultaneously in communication with a second actuator 60, said actuator being a linear actuator through line 54 which tees off line 55. Four way valve pressure outlet 53 is in communication with flow control valve 64 through line 61. Four way valve pressure outlet 53 is simultaneously in communication with linear actuator 60 through line 59 which tees off line 61. Flow control valve 64 is in metered communication with rotary actuator 56 through line 65. Thus, throttling the flow of air causes the tee to pivot slower. Flow control valve 64 provides a fine control for the pivotal travel of the tee 44. The tee rotates down to the tee loading station under no air restriction. The tee rotates slowly up to the strike position under restricted air flow so that the momentum of the ball revolving to the strike position will not break the vacuum seal.

Rotary actuator 56 is in fluid communication with four way valve pressure outlet 52 through line 55 when said rotary actuator 56 is in its contracting or golf tee descending state. Said rotary actuator 56 is in fluid communication with flow control valve 64 via line 65 and with four way valve pressure outlet 53 via line 61 when said first or rotary actuator 56 is in its extending or golf tee raising state.

Second (linear) actuator 60 is in fluid communication with four way valve pressure outlet 52 through line 55 and line 54 when said second actuator 60 is in its contracting state. Said second actuator 60 is in fluid communication with four way valve pressure outlet 53 via line 61 and line 59 when said second actuator 60 is in its extending state.

Figure 3:
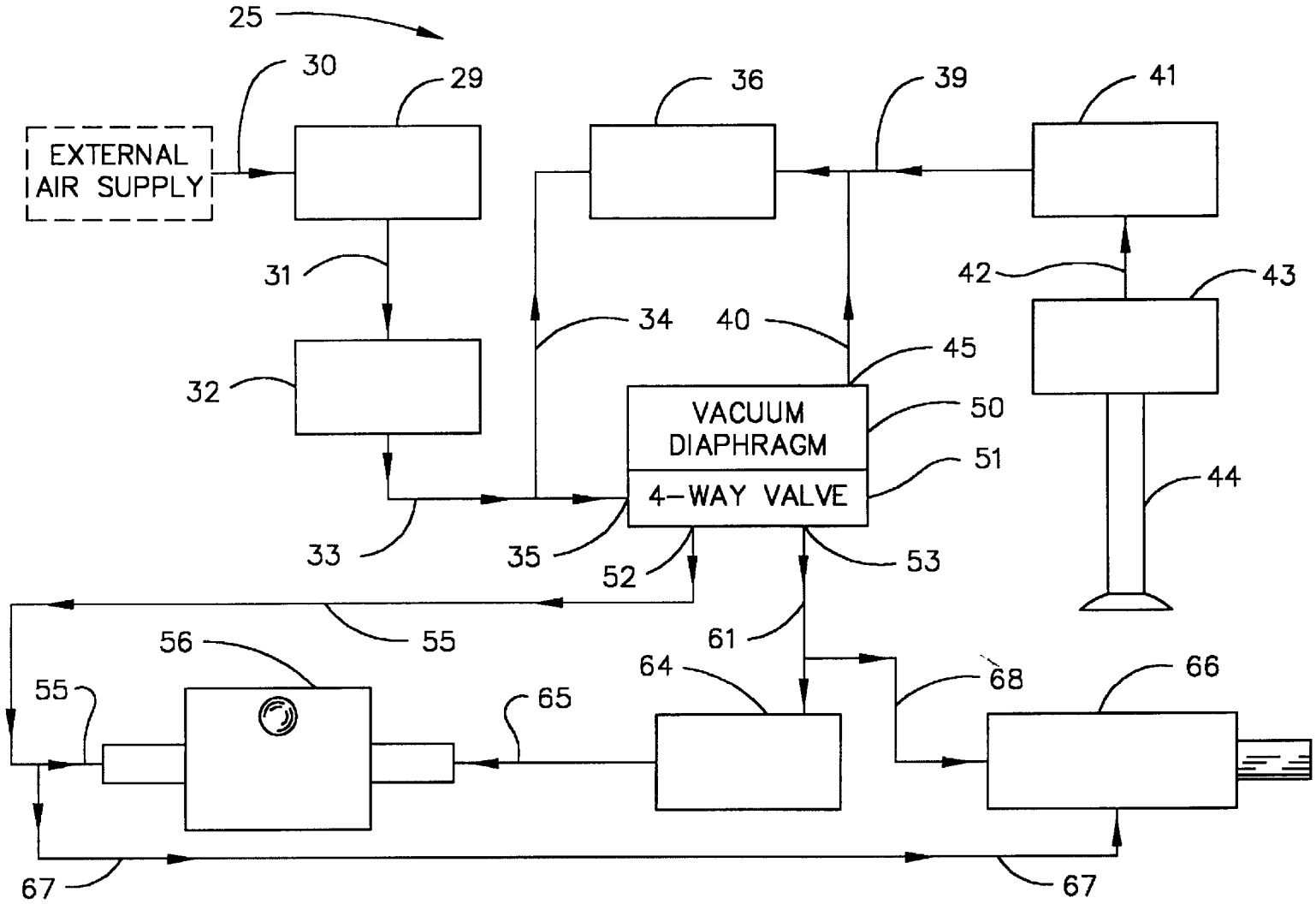
FIG. 3 is a version of FIG. 2 using an external automatic force feed golf ball source or gravity feed ball source requiring a ball jostling means.
Figure 10:
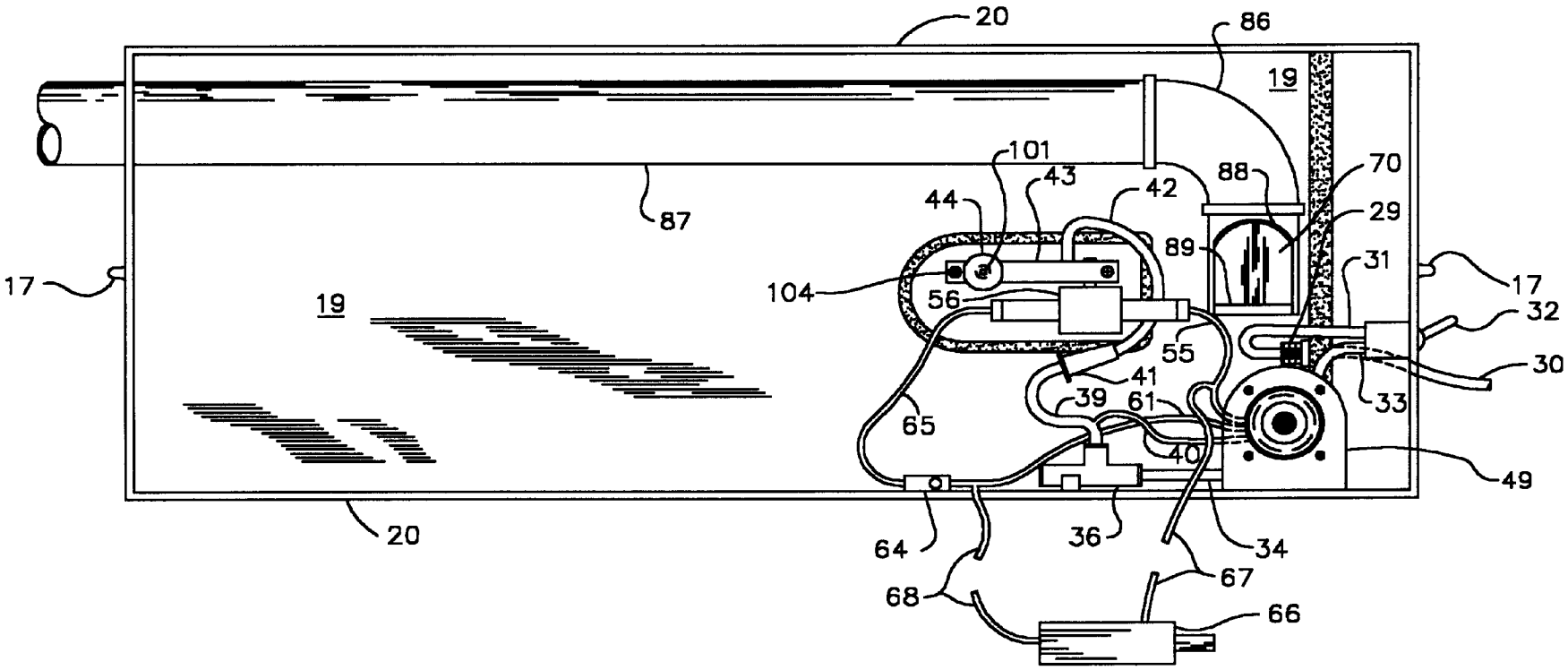
FIG. 10 is a version of the FIG. 9 embodiment depicting an external second actuator for force feeding balls from an external ball source or for jostling balls in a gravity external feed system.
Figure 12:
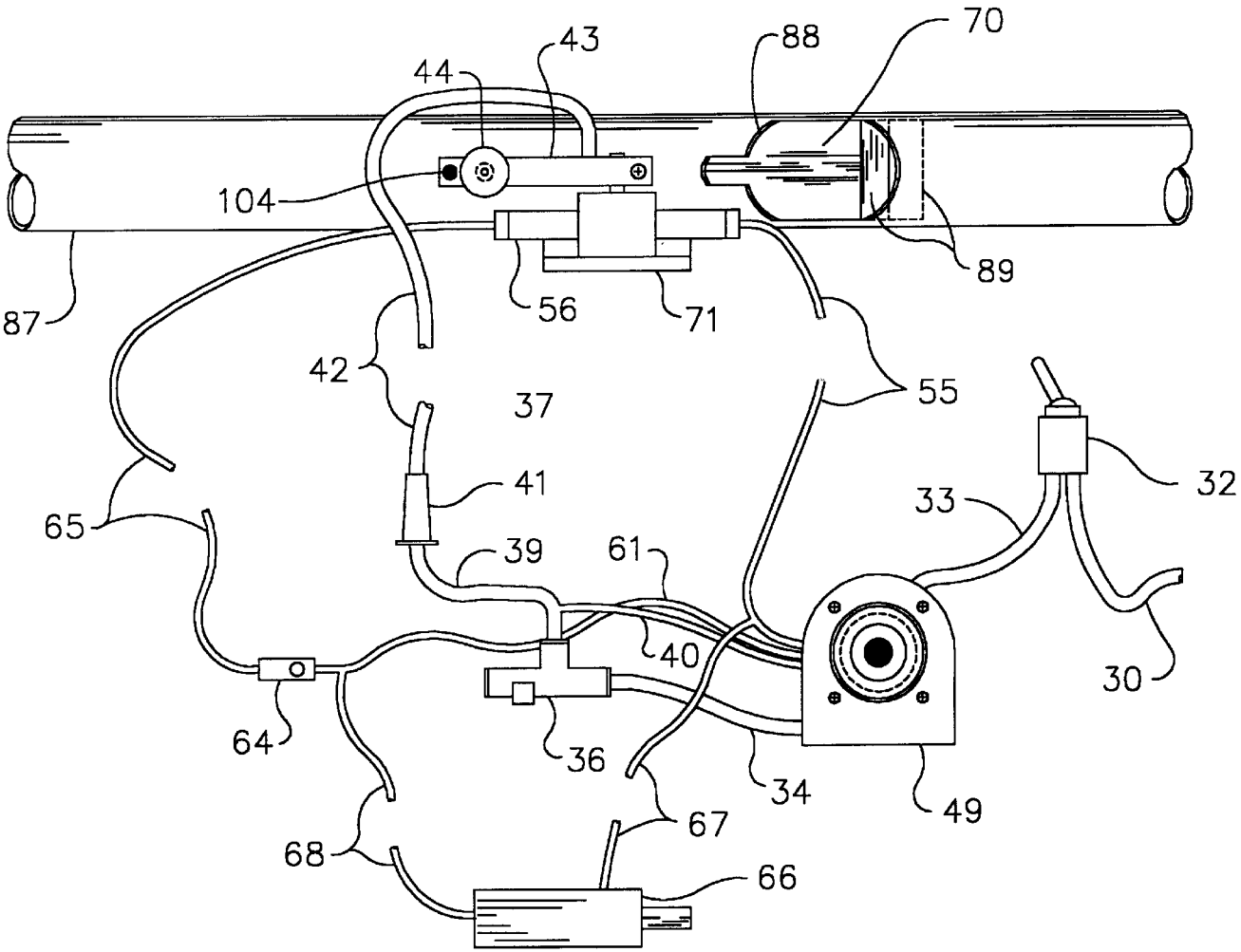
FIG. 12 is a depiction of the FIG. 11 embodiment including the addition of a second actuator for force feeding balls from an external ball source or for jostling balls in a gravity external feed system.

FIG. 3 is a diagrammatic representation disclosing another embodiment of the present invention, having an external ball source as depicted in FIGS. 10 and 12. It is similar to the control means in FIG. 2; however, the second actuator 66 is external to apparatus 11. Said actuator could be inclusive in a ball hopper. The actuator would jostle the balls by cycling to minimize congestion in an external ball hopper so that golf balls are gravity or force fed in single file to the tee loading station without bridging in the hopper. The input control signal for said second actuator 66 would be supplied by similar means whether configured internal or external to apparatus 11. Second actuator 66 is externally located and may assist balls to the tee loading station 70 as depicted in FIG. 10 and FIG. 12. For example, this may be accomplished by driving balls with direct second actuator 66 force for a force feed system or said actuator jostling balls to feed single file to tee loading station 70 for a gravity feed system or a combination of such features.

The FIG. 3 embodiment includes a second external actuator 66 in fluid communication with four way valve pressure outlet 52 through line 55 and line 67 when said second external actuator 66 is in its contracting state. Said second external actuator 66 is in fluid communication with four way valve pressure outlet 53 via line 61 and line 68 when said second actuator 66 is in its extending state.

Figure 4:
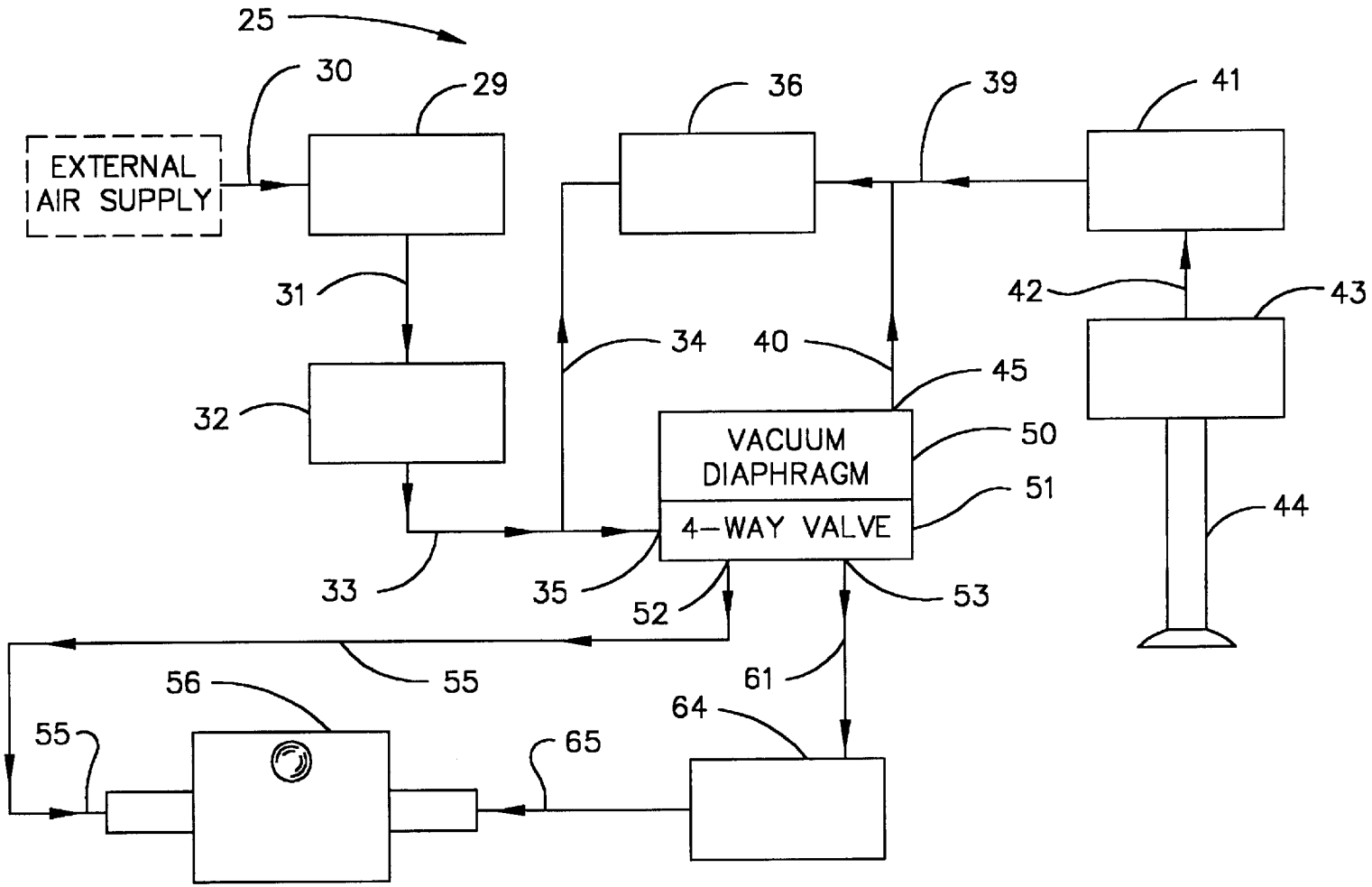
FIG. 4 is a version of FIG. 2 using an external gravity feed ball source.
Figure 9:
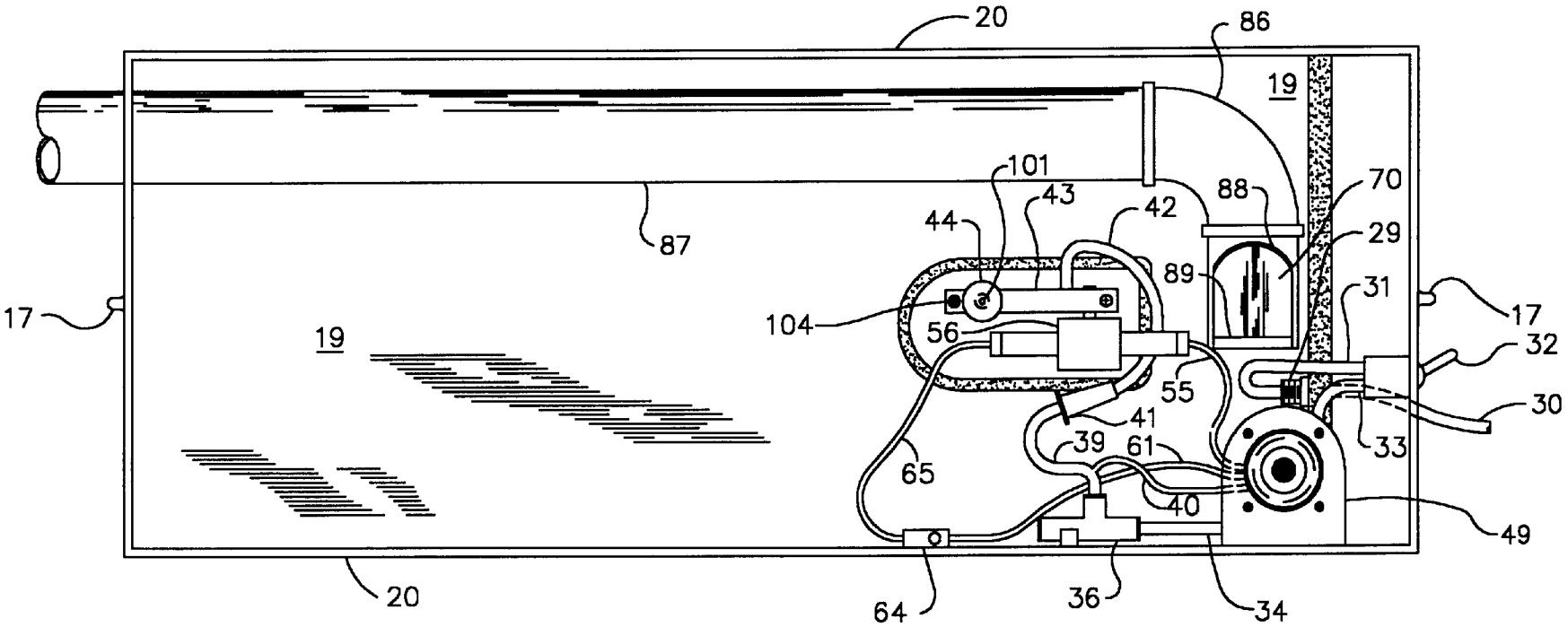
FIG. 9 is a simplified version of FIG. 6 with an external ball gravity feed source instead of the ball tray, slip sheet and related pneumatics.
Figure 11:
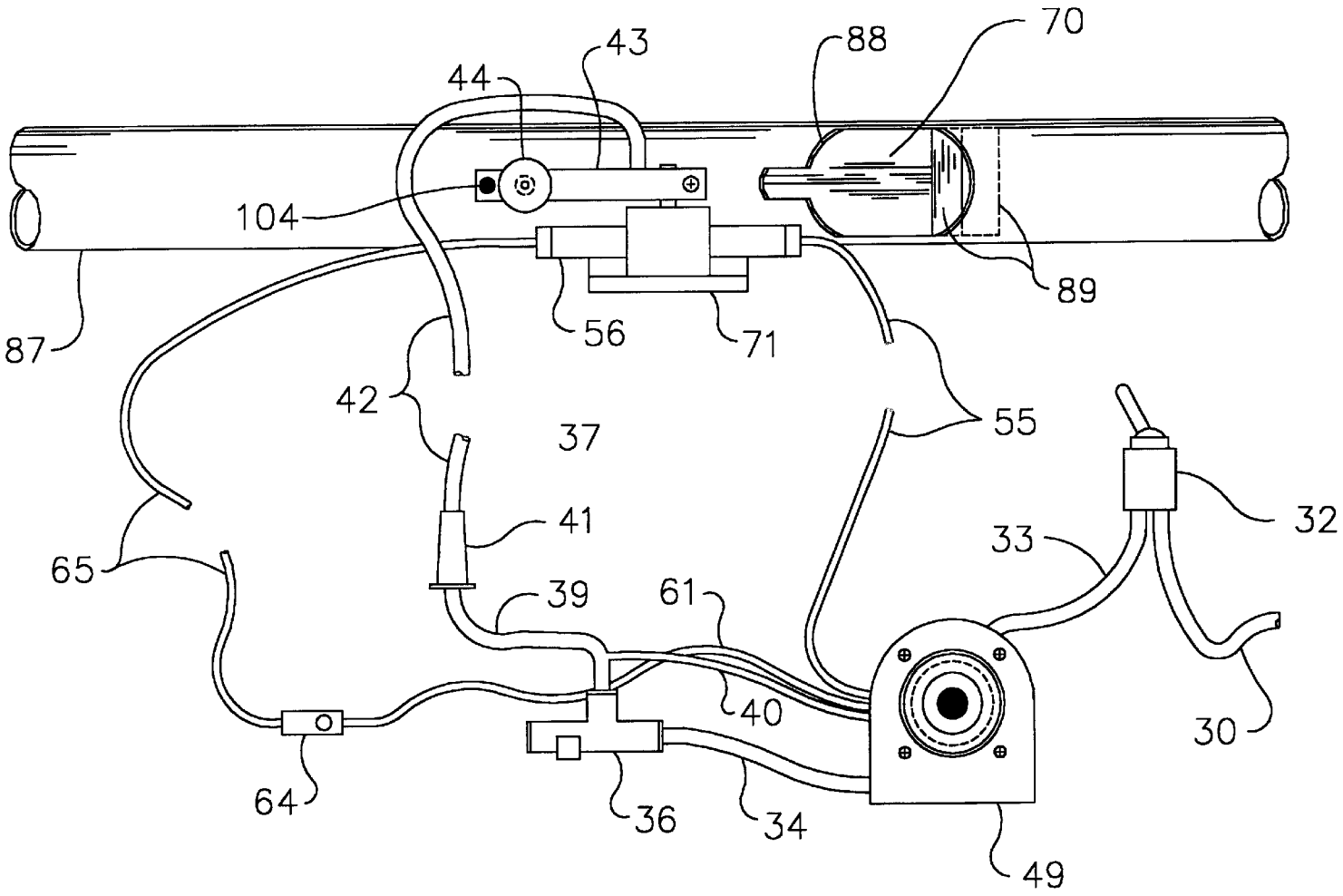
FIG. 11 is a top plan view of an exemplary embodiment of an apparatus for alternately positioning the tee between the ball pickup position to the vertical position wherein the apparatus is mounted directly to a conduit which transports golf balls to the tee loading station.

FIG. 4 discloses another embodiment having an external ball source being gravity fed into the apparatus as depicted in FIG. 9 and FIG. 11. In this embodiment, the golf balls would be batch supplied and free flowing under gravity to the device. When the complement of balls is exhausted, another batch would be sent. This batch of balls could be triggered by a token operated ball dispenser for example. Note that the second actuators 60 and 66 are eliminated in this configuration.

Figure 5:
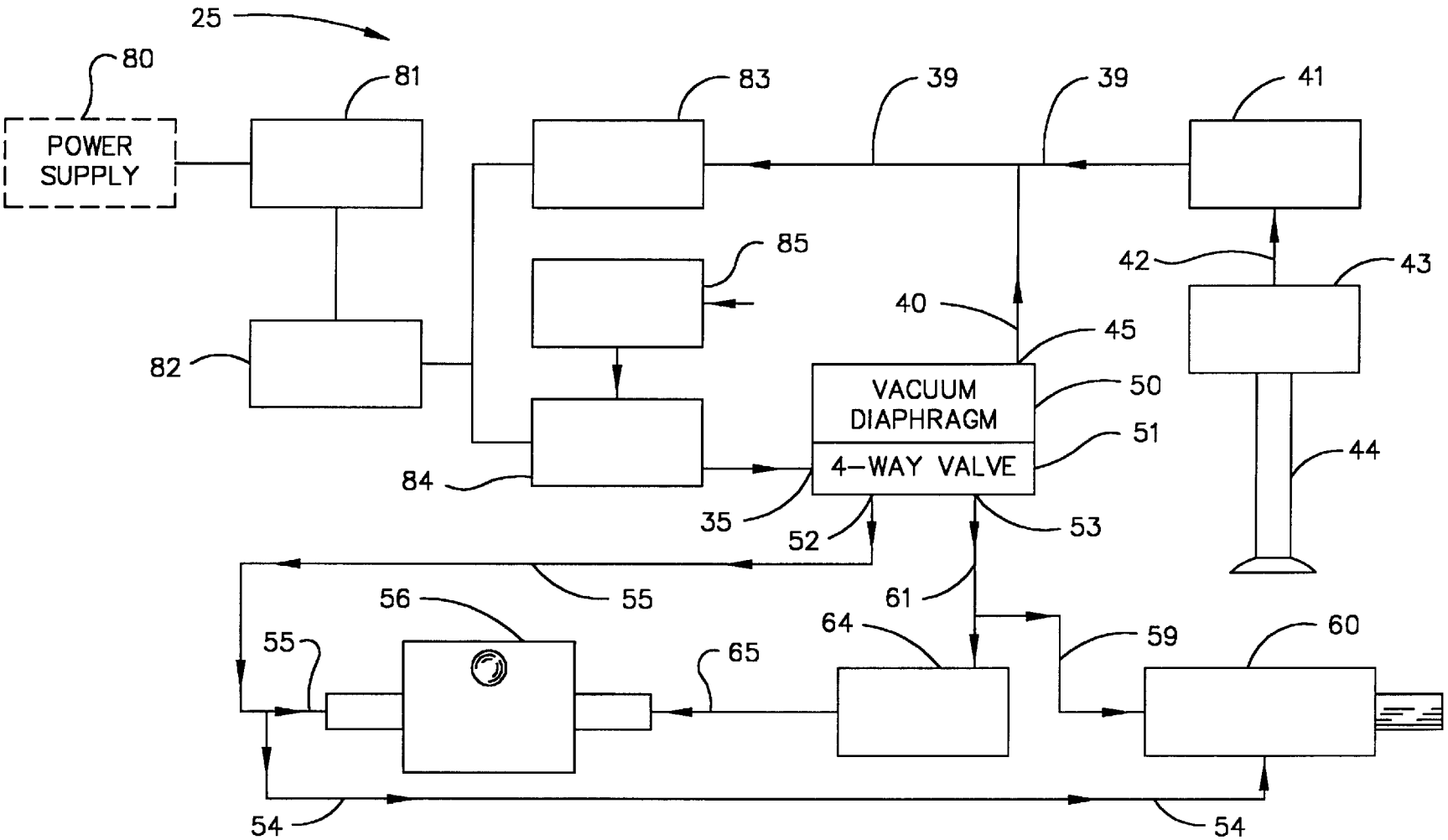
FIG. 5 is a version of FIG. 2 using an internal or external battery source to power a vacuum pump and air pump with internal golf ball storage and manual feed.

FIG. 5 discloses a further embodiment of the invention having an internal air/vacuum supply. It includes an internal battery or power supply 80 that is electrically connected through a fuse 81 and an on/off manual switch 82 to an internal vacuum pump 83 and an internal air compressor 84 having filter intake 85. The battery could be internal or external or simply a solar panel. As power supplies are miniaturized, those skilled in the art should easily be able to adapt such power supplies to the present invention.

An exemplary mechanical structure controlled by control means 25 or variations thereof is denoted 11 as a whole in FIG. 1 as aforesaid.

Apparatus 11 includes an elongated base having a bottom wall 19 and upstanding sidewalls 20 mounted about the periphery thereof. A golfer may stand above platform 12 when using apparatus 11, or the apparatus could be recessed into the ground so that its top wall 21 is flush with a ground surface. Flat top wall 21 having tee receiving slot 14, FIG. 13, formed therein is supported along its peripheral edges by said sidewalls 20. The apparatus includes a ball receiving opening 13 so that a bucket of golf balls may be introduced into the hollow interior of apparatus 11.

Alternately, the flat top wall 21 would not incorporate a ball receiving opening 13 in a external ball feed configuration control means depicted in FIGS. 9–12. Either or both flat top wall 21 configurations could be used to facilitate an internal manual feed backup system for primary external ball feed systems.

Apparatus 11 is positioned adjacent platform 12 when said apparatus 11 is in use; said apparatus and platform may be attached to one another or provided as separate parts. Both apparatus 11 and platform 12 are typically less than five inches in height; such height may be variable depending on the topography of the ground support (not shown) for the platform.

Figure 7:
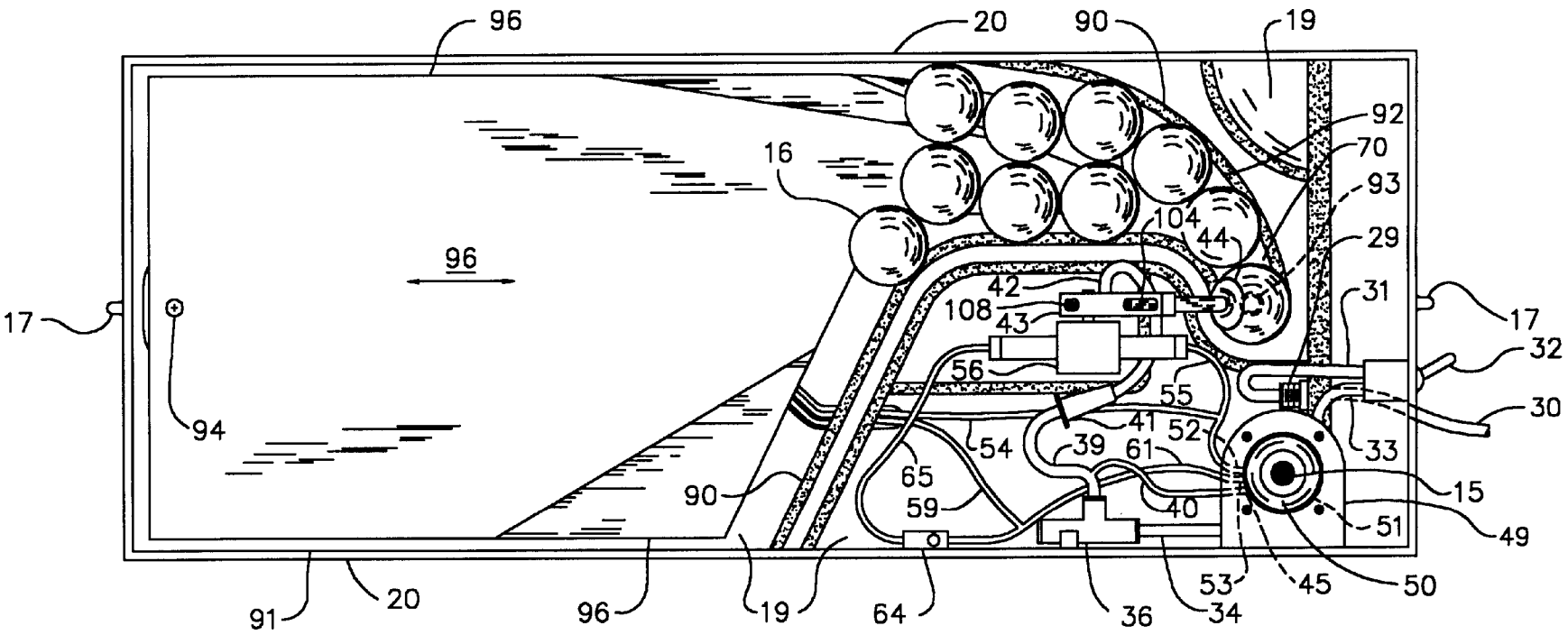
FIG. 7 is a perspective view of the apparatus depicting a plurality of golf balls in the ball tray and the golf tee rotated down in the ball pickup position at the tee loading station.

As disclosed in FIG. 6, a ball tray 90 integrally formed into the bottom wall 19 has a wide first end 91 that is tilted slightly from horizontal to feed balls under the force of gravity toward a second narrow end or neck 92 that terminates at tee loading station 70 where a recess 93 is formed to positively locate the ball for pickup. Second actuator 60 is preferably a double acting air cylinder horizontally disposed and its free end is connected to a relatively flat tray insert or slip sheet 96; the flat tray insert 96 may be flat except for a compound curve at the neck end 92 and terminating wide end 91 of the integral ball tray 90 to urge balls to enter the tee loading station 70; it includes mount 95 which attaches the second actuator 60 to the bottom wall 19. More particularly, bottom wall 19 is engaged by upstanding post 94 that is mounted to base member 97 which is secured to the leading end of plunger 98. Post 94 extends through hole 99 in the bottom wall of flat tray insert 96. When said flat tray insert is displaced by reciprocation of plunger 98 as indicated by the double-headed arrow in FIGS. 6 and 7, such displacement prevents bridging of balls.

Second actuator 60 plunger 98 is fastened to a base member 97. An upstanding post 94 attaches flat tray insert 96 to base member 97. Said actuator 60 performs the function of ball-jostling means by periodically moving slip sheet 96 to help jostle balls toward tee loading station 70. Trough 57 formed in bottom wall 19 permits air lines 54 and 59 in fluid communication with second actuator 60 to pass under flat tray insert 96.

Figure 8:
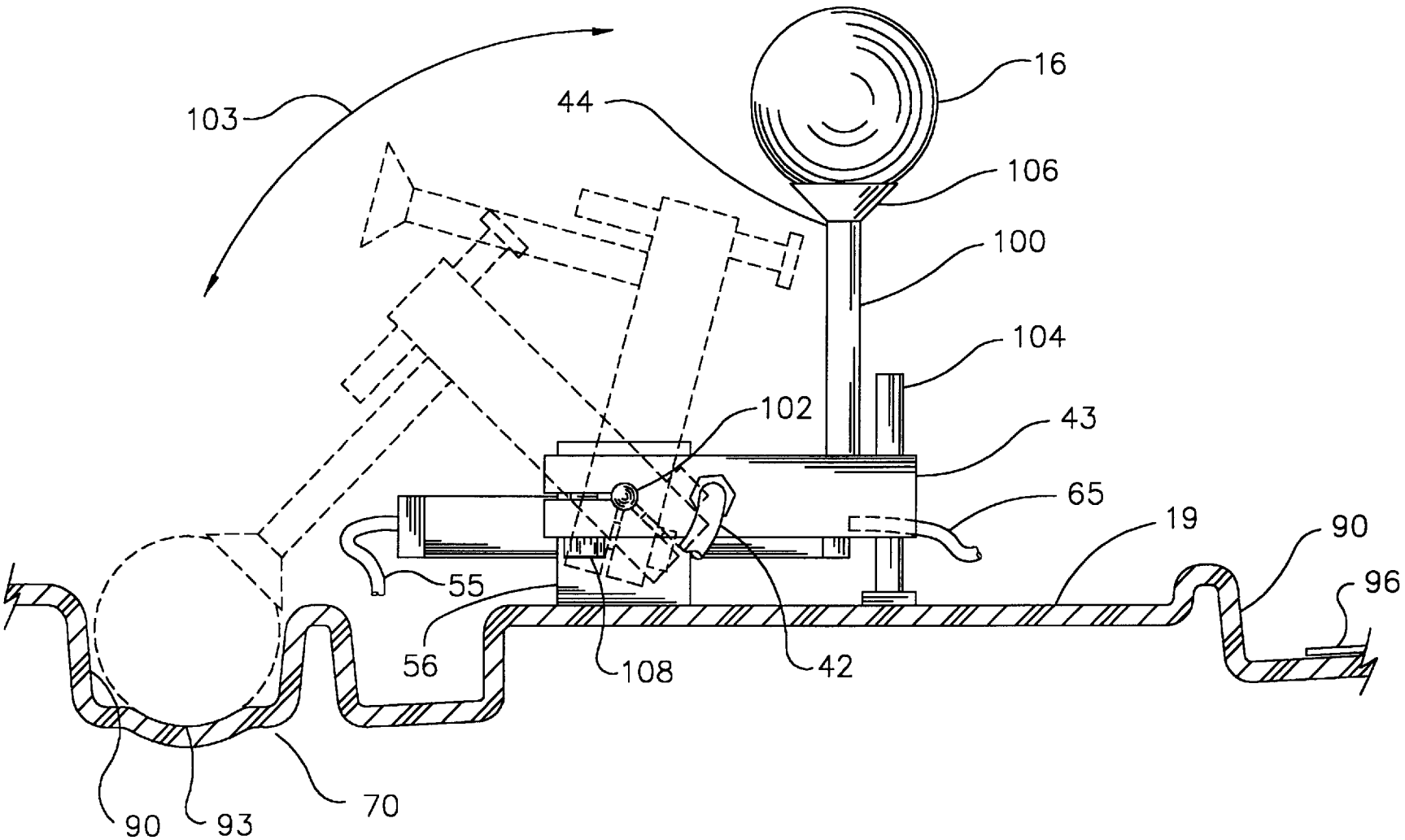
FIG. 8 is a side elevation view of a first embodiment for alternately positioning the tee from the ball pickup position to the vertical position with tee height control means.

As shown in FIGS. 6 and 8, tee 44 includes elongate stem 100 and a flared ball supporting surface 106. A central bore 101 formed in the tee 44, is in communication with said tee loading station 70 at a leading end thereof and with a vacuum line 42 at a trailing end thereof, said vacuum line being in fluid communication with vacuum generator 36. Vacuum golf tee manifold 43 is internally bored so that the vacuum in line 42 is transmitted to tube 100 to maintain a golf ball on tee supporting face 106 of golf tee 44.

The sequential operation of the novel apparatus is best understood by considering the state of the four way valve, the vacuum, and all actuators during each of the four modes of the apparatus.

The first mode is the ball strike mode. When in this configuration, tee 44 is in its predominately or substantially vertical position and a ball is gripped by a vacuum appearing in vacuum line 42. The vacuum circuit is closed because the ball is seated on the tee and the vacuum cannot bleed. Diaphragm 50 compresses under negative pressure to reconfigure four way valve 51. Port 53 of four way valve 51 is open, actuator 60 is extended, and actuator 56 may be in a retracted or extended configuration, depending upon the particular mechanism employed to effect righting of the tee, as will be disclosed hereinafter. Actuator 56 will rotate to raise the ball into the ball strike position.

When the golfer strikes the ball, or manually removes it from the tee, the mechanism is said to be in its ball-struck mode. Since the ball is no longer seated on the tee, the vacuum is bleeding.

Atmospheric pressure is introduced to the tee 44 and the diaphragm 50 returns to its neutral position under spring force from the four way valve 51. The reconfigured four way valve 51 shifts to open port 52, and actuator 56 begins retracting or revolving down. Actuator 60 is retracted so that slip sheet 96 returns to its position of repose. The purpose of actuator 60 is to jostle the balls to minimize bridging.

In the next mode of the apparatus, called the ball pick-up mode, the tee has rotated to its ball pickup position which, in the arrangement of components as depicted in FIG. 8, is about 45°–60° from horizontal, and a ball has rolled into the ball recess 93 at tee loading station 70. Vacuum is building up in the circuit, and port 52 of four way valve 51 is open. Actuator 60 is retracted. Actuator 56 is extended or retracted, depending upon the mechanism for rotating the tee as aforesaid.

When the vacuum has built up to the point where the ball is firmly held in the tee 44, the apparatus is said to be in its ball lifting mode because the tee is being lifted into its vertical position. Accordingly, the vacuum circuit is closed and four way valve 51 shifts to open port 53. Actuator 56 is extending or retracting depending upon the mechanism used, actuator 60 is extended. The extension of actuator 60 moves slip sheet 96 to assure free-flowing movement of balls.

At the conclusion of the ball lifting operation, the apparatus returns to its initial striking mode and the above-described cycle repeats when the golfer strikes the ball or otherwise removes it from the tee.

In normal operation, the above-described four modes are the only modes of the machine, in this first embodiment. However, if a ball is somehow unable to roll into the tee loading station 70 recess 93 even when slip sheet jostling actuator 60 extends and directs the balls toward said station, it is possible that the tee may return to its pick-up position and the tee 44 will bar entrance of a ball into tee loading station 70. The machine remains in that configuration until steps are undertaken to move said tee 44 so that a ball may enter the tee loading station. In anticipation of this condition, four way valve 51 is mounted within apparatus 11 such that its diaphragm stem 15 of vacuum diaphragm 50 protrudes slightly above the surface of top wall 21 as depicted in FIG. 1. The golfer, upon noticing that a ball is not present for striking in the normal sequence of events, simply presses downwardly on said protruding stem 15. This causes port 53 of four way valve 51 to open, thereby causing actuator 56 to rotate the golf tee 44 so that a ball can enter the tee loading station recess 93 and the machine can return to its normal cycle of operation. In a worst case scenario where the balls are jammed and unable to roll into the ball loading station, the golfer could remove top wall 21 of apparatus 11 and manually place a ball into the tee loading station to release the jamming.

It is also possible that a ball may be so badly scarred that a deep groove formed therein prevents its adherence to the tee because the groove prevents the vacuum from building. A ball of such physical deterioration can be removed from the system in the same way, i.e., top wall 21 is removed, the protruding diaphragm stem 15 is depressed to retract actuator 56 so that the tee is rotated to its predominantly or substantially vertical strike position, and the ball is removed from the system. A new ball rolls into the tee loading station and the system returns to normal operation. Alternatively, pressing down on stem 15 a number of times will also usually cause such a ball to be lifted by the tee because the repeated attempts to lift the ball will cause the ball to rotate until a grippable surface is presented to the tee.

The above-described configurations of the novel apparatus are summarized in the following state variable Table.

TABLE 1

| Tee Position | Vacuum | 4-way Valve | Cyl 1 | Cyl 2 |
|---|---|---|---|---|
| Up | Closed (Sealed on Ball) | Port 53 Open | Rotated Up (Extended) | Out |
| Going Down | Bleeding | Port 52 Open | Rotating Down (Retracting) | In |
| Down | Building (Sealed on Ball) | Port 52 Open | Rotated Down (Retracted) | In |
| Going Up | Closed (Sealed on Ball) | Port 53 Open | Rotating Up (Extending) | Out |

Note that in Table 1, Cylinder 1 is rotary actuator 56 and Cylinder 2 is linear actuator 60.

A rotary actuator 56 is depicted in FIG. 8. Stem 100 of tee 44 is conjointly rotatable with output shaft 102 of the rotary actuator 56 via vacuum tee manifold 43. Thus, the tee rotates between its predominately or substantially vertical or ball strike position and its ball pick-up position as indicated by double-headed directional arrow 103 as the rotary actuator operates. Vacuum tee manifold 43, which may have a keyway to index the output shaft key, is held in position on output shaft (102) with clamping fastener 108 or any other suitable means known in the art. The vacuum line 42 is in communication with the golf tee manifold 43. A tee height control means is shown using a post 104. Said post 104 may consist of a standard threaded fastener in which the tee height is raised as the threaded fastener is extended and lowered as the threaded fastener is retracted or screwed in. In another configuration, said post 104 may also have a ribbed surface and the tee arm manifold would have a spring plunger. The spring plunger engages the post so that the ribbed surface provides a detent stop for various vertical tee height adjustments. Note that adjustment of post 104 or other means (not shown) allows for manual tee height adjustment, thus eliminating the need for more costly automatic tee height adjustment means. However, an automatic tee height control means could also be incorporated.

FIG. 9 depicts a second embodiment of an external ball source system with gravity feed golf balls in single file through golf ball conduit 87 to the tee loading station 70 in apparatus 11. Golf ball conduit 87 is shown to enter from the rear and approach the tee loading station 70 through transitional elbow 86. The golf ball conduit may enter apparatus 11 from various locations passing through side wall 20 or bottom wall 19. How the ball gets to the loading station 70 in this embodiment can be accomplished by running the conduit in any suitable manner to suit the application as long as the ball is capable of being gravity fed to the loading station. Tee 44 passes through tee opening 88 to pick up ball at tee loading station 70. End block 89 stops the ball at the tee loading station.

FIG. 10 depicts a second embodiment of an external ball source system of FIG. 9 with an external actuator for assisted gravity feed or force feed of golf balls in single file through golf ball conduit 87 to the tee loading station 70 in apparatus 11. Golf ball conduit 87 is shown to enter from the rear and approach the tee loading station 70 through transitional elbow 86. The golf ball conduit may enter apparatus 11 from various locations passing through side wall 20 or bottom wall 19. End block 89 would not be required in a bottom wall 19 feed system. As with the FIG. 9 embodiment, the manner in which the ball enters the apparatus and gets to loading station 70 can be accomplished in any suitable way suitable to the application. Tee 44 passes through tee opening 88 to pick up ball at tee loading station 70. End block 89 stops the ball at the tee loading station. Said end block may be an incline wedge so that when a ball is forced by second actuator 66 through ball conduit 87 against end block 89 the ball will ascend up the incline to meet the tee 44. Second external actuator 66 is in fluid communication with four way valve pressure outlet 52 through line 67 when said second external actuator 66 is in its extending state. Said second external actuator 66 is in fluid communication with four way valve pressure outlet 53 via line 68 when said second actuator 66 is in its contracting state. Second actuator 66 is shown with broken air lines as it may be located distant from vacuum diaphragm/4-way valve assembly 49. Said second actuator 66 could be inclusive in a ball hopper. The actuator would jostle the balls by cycling to minimize congestion in an external ball hopper so that golf balls are gravity or force fed in single file through golf ball conduit 87 to the tee loading station 70 without bridging in the hopper.

FIG. 11 depicts another embodiment of an external ball source system with gravity feed golf balls in single file through golf ball conduit 87 to the tee loading station 70. Rotary actuator 56 mounted directly to golf ball conduit 87 with bracket 71. End wall 89 bars the golf ball and locates the ball properly in the tee loading station 70. Tee 44 passes through tee opening 88 to pick up ball at tee loading station 70. Golf ball conduit 87 and end wall 89 may be configured so that balls may approach tee loading station 70 from any direction. Bracket 71 may be configured to mount rotary actuator 56 as required for golf ball conduit arrangement. Control means 25 primarily consisting of diaphragm 4-way valve assembly 49, vacuum generator 36, on/off valve 32 and flow control valve 64 are shown with broken tubing as they may be located distant from the ball pickup means primarily consisting of rotary actuator 56 and golf ball conduit 87.

FIG. 12 depicts a further embodiment of an external ball source system of FIG. 11 with external actuator for assisted gravity feed or force feed golf balls in single file through golf ball conduit 87 to the tee loading station 70. Rotary actuator 56 mounted directly to golf ball conduit 87 with bracket 71. End wall 89 bars the golf ball and locates the ball properly in the tee loading station 70. Golf ball conduit 87 and end wall 89 may be configured so that balls may approach tee loading station 70 from any direction. Bracket 71 may be configured to mount rotary actuator 56 as required for golf ball conduit arrangement. Tee 44 passes through tee opening 88 to pick up ball at tee loading station 70. End block 89 stops the ball at the tee loading station. Said end block may be an incline wedge so that when a ball is forced by second actuator 66 through ball conduit 87 against end block 89 the ball will ascend up the incline to meet the tee 44. Second external actuator 66 is extending in fluid communication with four way valve pressure outlet 52 through line 67 when said actuator 56 is in its contracting state. Said second external actuator 66 is contracting in fluid communication with four way valve pressure outlet 53 via line 68 when said actuator 56 is in its extending state. Control means 25 primarily consisting of diaphragm 4-way valve assembly 49, vacuum generator 36, on/off valve 32 and flow control valve 64 are shown with broken air lines as they may be located distant from the ball pickup means primarily consisting of rotary actuator 56 and golf ball conduit 87. Second actuator 66 is shown with broken air lines as it may be located distant from diaphragm 4-way valve assembly 49. Said second actuator 66 could be inclusive in a ball hopper. The actuator would jostle the balls by cycling to minimize congestion in an external ball hopper so that golf ball are gravity or force fed in single file through golf ball conduit 87 to the tee loading station 70 without bridging in the hopper.

Figure 13:
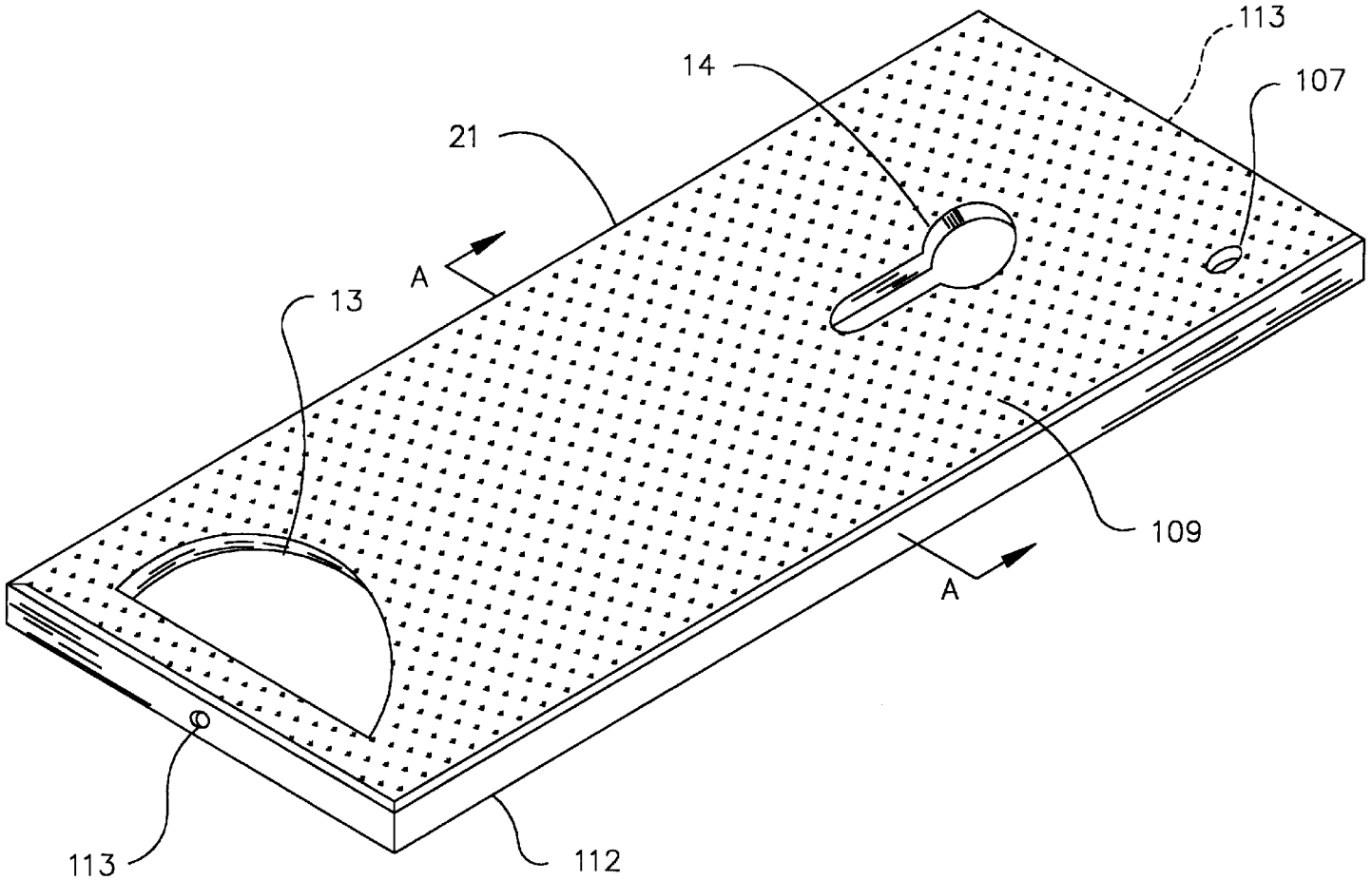
FIG. 13 is a perspective view of the novel resilient top wall manifesting flexible characteristics.

FIG. 13 depicts a novel flexible top wall 21 of apparatus 11. Flexible top wall 21 is positioned atop apparatus 11 as in FIG. 1. The top wall 21 is comprised of tee receiving slot 14 for raising the ball to the ball strike position; ball receiving opening 13 for manually charging the machine with golf balls which is not required for external ball feed systems; reset button receiving opening 107 for vacuum diaphragm button 15; and engagement means for the top wall 21 into the side walls 20 of the apparatus 11, said engagement means typically being two or more post receiving holes 113 which engage an outstanding post 17 located on side wall 20.

As depicted in FIG. 13, the top wall 21 consists of side wall 112 which positions by engaging outside bottom side wall 20. More particularly top wall 21 is engaged by outstanding post 17, as shown in FIG. 6, that is mounted to side wall 20 to maintain proper position on apparatus 11. Top wall 21 must be removed to access internal workings of apparatus 11. Top wall 21 is secured to side wall 20 by post receiving hole 113 at outstanding post 17. Top wall 21 is disengaged from side wall 20 at outstanding post 17 by flexing outward away from side wall 20 at the location of post receiving hole 113.

Flexible top wall 21 will reduce the force induced to the golfer's wrist and golf club compared to striking typical stiff artificial turf hitting mats. Furthermore, the top of the described construction allows the clubhead to "dig" below the plane of the "grass", thereby more closely resembling a divot and producing a more correct presentation of the clubface to the ball. Moreover, top wall 21 is more durable than said artificial turf as it deflects out of the golf club path so that its use still further increases the time the novel apparatus can operate without maintenance. Since top wall 21 is removably mounted as indicated, it may be replaced when worn.

Top wall 21 may also be utilized as a stand alone unit. It may be placed directly on the ground as a hitting or striking surface. The openings shown would not be required for this application; however, a hole adapted to accept typical polymeric tees may be used to tee up the ball at various heights.

Figure 13A:
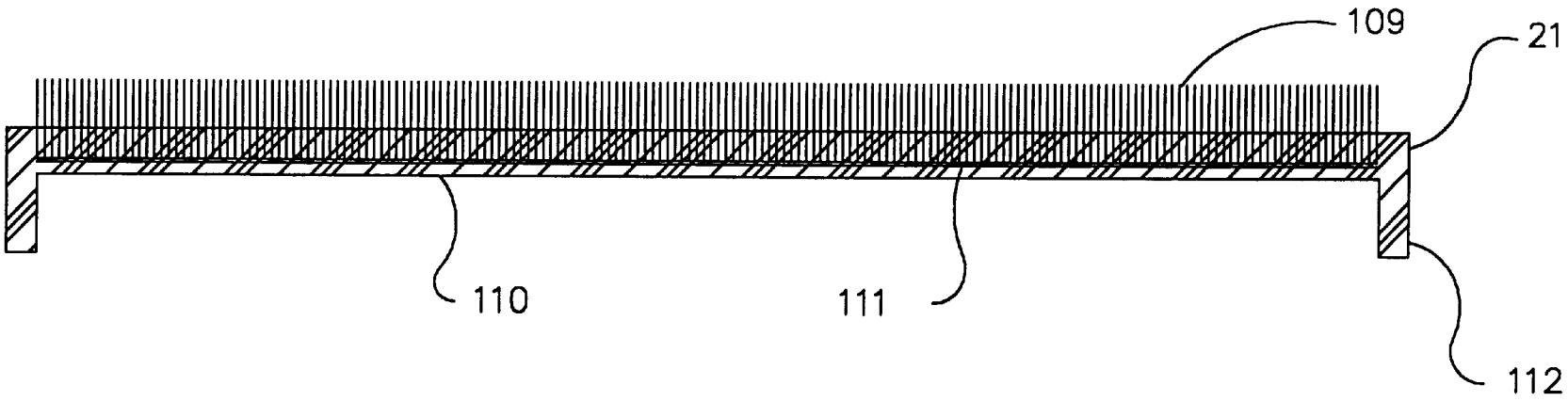
FIG. 13A is a cross-sectional view of the resilient top wall of FIG. 13.

FIG. 13A depicts a cross-sectional view "A—A" of top wall 21 FIG. 13. Artificial turf 109 is impregnated in a polymeric compound 110 completely encapsulating artificial turf backing 111. This mechanical lock and chemical bond insures longevity during repeated golf club impacts. The polymeric composite flexible top wall 21 may be modified chemically or mechanically to produce unlimited flexibility ranges.

This present invention allows a golfer to hit as many golf balls off a tee as the golfer can physically endure without once bending over, or changing his stance or grip. Of course, the golfer can make minute adjustments, if so desired, in grip or stance and study the effects thereof upon ball trajectory. The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for positioning a golf ball onto a tee, comprising:

means for supplying a source of negative pressure;

a flexible tee having a stem portion and an integral cup-shaped ball support portion;

the flexible tee further including a bore extending from said cup-shaped ball support portion through said stem, said bore being in fluid communication with said source of negative pressure so that a golf ball seated on said cup-shaped portion is held thereto by negative pressure;

a tee-loading station being a size adapted to admit thereinto only one golf ball at a time;

means for supplying a source of golf balls to the tee-loading station;

tee-loading means for rotatably positioning the cup-shaped portion of the flexible tee into sealing engagement with a golf ball at the tee-loading station and for rotatably repositioning said engaged golf ball into a substantially vertical position, said tee-loading means including a rotary actuator, the rotary actuator further including a vacuum tee manifold pivoting from the rotary actuator, the flexible tee being oriented generally perpendicular to and near an end of the vacuum tee manifold, wherein the rotary actuator causes the vacuum tee manifold to rotate such that the cup-shaped portion of the flexible tee is rotated into direct contact with the golf ball for sealing engagement with said golf ball; and control means for activating said tee-loading means to move said flexible tee from the tee-loading station, where a golf ball is sealed to the cup-shaped portion of the flexible tee, to said substantially vertical position where the golf ball is ready to be struck, and to reposition the tee-loading means from the substantially vertical position after the golf ball has been struck to the tee-loading station for sealing engagement of the tee with another golf ball.

2. The apparatus according to claim 1, further comprising tee-height adjustment means being integrally cooperative with the tee-loading means.

3. The apparatus according to claim 2, wherein the tee-height adjustment means is manually adjustable.

4. The apparatus according to claim 1, further comprising:

a tray for holding a plurality of golf balls, said tray being sloped toward said tee-loading station to deliver golf balls to said tee-loading station; and ball jostling means positioned within said tray in movable relation thereto, including a linear actuator located internal to the apparatus having a retracted position and an extended position and being connected to said ball jostling means so that activation of the linear actuator results in jostling of the ball in said tray.

5. The apparatus according to claim 4, wherein said control means includes a four-way valve in fluid communication with said rotary and linear actuators.

6. The apparatus according to claim 1, further comprising means for delivering golf ball through a conduit from a remote source to the tee-loading station, wherein the golf balls are gravity fed to said tee-loading station.

7. The apparatus according to claim 1, wherein said source of negative pressure is a battery operated vacuum pump and wherein said apparatus is portable.

8. The apparatus according to claim 1, wherein said source of negative pressure is a venturi effect vacuum generator that receives energy from a remote compressor.

9. The apparatus according to claim 1, wherein said ball-supporting surface of said tee is flexible and resilient so as to allow a vacuum seal against a dimpled surface of the golf ball, and wherein said ball-supporting surface of said tee is durable so as to withstand repeated strikes from a golf club head.

10. The apparatus according to claim 1, further comprising:

an elongated base having a bottom wall, upstanding side walls mounted about the periphery of said bottom wall and a detachably secured durable and resilient top wall; and a tee-receiving slot formed in said top wall, wherein said top wall is in a surrounding relation to said tee-receiving slot.

11. The apparatus according to claim 10, wherein said top wall comprises:

a top layer of artificial turf with a backing, said turf being molded and impregnated with the backing in a polymeric compound encapsulating said turf backing; and peripheral downward side walls integral with the molded polymeric compound for engagement with the upstanding side walls of the elongated base.

12. The apparatus according to claim 10, further comprising:

means for delivering golf balls through a conduit from a remote source to the tee-loading station; and a linear actuator located external to the elongated base for actuating the means for delivering golf balls through the conduit from the remote source to the tee-loading station.

13. The apparatus according to claim 6, wherein the control means includes a four-way valve in fluid communication with said rotary actuator.

14. The apparatus according to claim 12, wherein said control means includes a four-way valve in fluid communication with said rotary actuator and said external linear actuator.

* * * * *